US009700086B2

(12) United States Patent
Gamble

(10) Patent No.: US 9,700,086 B2
(45) Date of Patent: Jul. 11, 2017

(54) MULTI-USE GARMENT

(71) Applicant: Michelle Gamble, Bloomfield Hills, MI (US)

(72) Inventor: Michelle Gamble, Bloomfield Hills, MI (US)

( * ) Notice: Subject to any disclaimer, the term of this patent is extended or adjusted under 35 U.S.C. 154(b) by 63 days.

(21) Appl. No.: 14/502,296

(22) Filed: Sep. 30, 2014

(65) Prior Publication Data

US 2015/0089712 A1 Apr. 2, 2015

Related U.S. Application Data

(63) Continuation-in-part of application No. 29/503,226, filed on Sep. 24, 2014.

(60) Provisional application No. 61/884,542, filed on Sep. 30, 2013.

(51) Int. Cl.

| | |
|---|---|
| ***A41D 15/00*** | (2006.01) |
| ***A41D 27/20*** | (2006.01) |
| ***A41D 3/08*** | (2006.01) |

(52) U.S. Cl.

CPC ..... *A41D 15/00* (2013.01); *A41D 3/08* (2013.01); *A41D 27/208* (2013.01)

(58) Field of Classification Search

CPC ..... A41D 15/00; A41D 27/208; A41D 3/08
See application file for complete search history.

(56) References Cited

U.S. PATENT DOCUMENTS

| | | | | | |
|---|---|---|---|---|---|
| 1,496,283 | A * | 6/1924 | Wright | A41D 15/00 | 2/1 |
| 1,509,296 | A | 9/1924 | Hopewell | | |
| 2,024,044 | A * | 12/1935 | Johnson | A41D 15/04 | 2/88 |
| 3,160,892 | A | 12/1964 | Semons | | |
| 3,370,370 | A * | 2/1968 | Lippman | G09F 21/02 | 2/247 |
| 3,473,167 | A | 10/1969 | Jeffrey | | |
| 4,227,264 | A | 10/1980 | Spector et al. | | |
| 4,258,439 | A * | 3/1981 | York | A41D 15/00 | 2/69.5 |
| 4,484,362 | A | 11/1984 | Asher | | |
| 4,961,235 | A * | 10/1990 | Williger | A41B 11/006 | 2/239 |
| 5,079,779 | A | 1/1992 | Spector et al. | | |
| 5,875,492 | A * | 3/1999 | Moss | A41D 3/08 | 2/82 |
| 5,901,375 | A * | 5/1999 | Davis | A41D 15/04 | 2/69 |
| 6,408,462 | B1 * | 6/2002 | Moore | A41D 3/08 | 2/69 |
| 6,468,612 | B1 | 10/2002 | Symonds | | |
| 6,708,343 | B1 * | 3/2004 | Ceron | A41D 3/08 | 2/84 |
| 7,496,971 | B2 | 3/2009 | Soto | | |

(Continued)

FOREIGN PATENT DOCUMENTS

FR 2309182 A1 * 11/1976 ..... A41D 3/08

*Primary Examiner* — Anna Kinsaul
(74) *Attorney, Agent, or Firm* — Dinsmore & Shohl LLP

(57) ABSTRACT

A multi-use garment includes a generally rectangular body of fabric material, a first and second arm hole defined through the body of fabric material and symmetrically disposed side to side. A first and a second pocket may be provided as well as a plurality of connecting elements and/or sleeve fastening elements.

19 Claims, 16 Drawing Sheets

(56) References Cited

U.S. PATENT DOCUMENTS

| | | | | |
|---|---|---|---|---|
| 8,214,923 | B2 | 7/2012 | Lee | |
| 8,464,374 | B1 | 6/2013 | Thayer | |
| 2005/0005355 | A1* | 1/2005 | Marks | A47G 9/062 5/417 |
| 2005/0081276 | A1* | 4/2005 | Reynolds | A41D 3/08 2/69 |
| 2010/0146680 | A1 | 6/2010 | Cuoco | |
| 2011/0307992 | A1 | 12/2011 | Martinson | |
| 2012/0079644 | A1 | 4/2012 | Benderradji | |

* cited by examiner

MULTI-USE GARMENT

CROSS-REFERENCE TO RELATED APPLICATIONS

This application claims priority of U.S. Provisional Application 61/884,542, filed Sep. 30, 2013, and is a continuation-in-part of U.S. Design Application 29/503,226, filed Sep. 24, 2014, the entire content of each of which is incorporated herein by reference.

FIELD OF THE INVENTION

The present invention relates to apparel or garments and, more specifically, to a garment with multiple configurations and uses.

BACKGROUND OF THE INVENTION

There are a wide variety of apparel items and garments available, yet there remains a need for a garment that may be reconfigured for multiple uses.

SUMMARY OF THE INVENTION

The present invention provides various embodiments of a multi-use garment having a generally rectangular body of fabric material and a plurality of connecting elements or fastening elements to assist in configuring the garment in a variety of ways. The garment may have a pair of arm holes, a pair of pockets, a storage pocket, and/or other features depending on the specific embodiment.

A first embodiment of a multi-use garment includes a generally rectangular body of fabric material having a front face and an opposed rear face, the body of fabric material having an upper edge, a lower edge, and a pair of opposed side edges each extending between the upper and lower edges. A horizontal center line is defined midway between the upper and lower edges and a vertical center line is defined midway between the side edges. A first and a second arm hole is defined through the body of fabric material, the arm holes being generally symmetrically disposed on opposite sides of the vertical center line. A first and a second pocket element are each attached to the front face of the body of fabric material so as to define a respective first and second pocket each having a pocket opening. The first and second pocket elements are generally symmetrically disposed on opposite sides of the vertical center line and are disposed above the horizontal center line. The pocket openings are each directed toward the vertical center line of the body of fabric material. A first pair of connecting elements is disposed on the front face of the body of fabric material and generally symmetrically disposed on opposite sides of the vertical center line. A second pair of connecting elements is disposed on the rear face of the body of fabric material and generally symmetrically disposed on opposite sides of the vertical center line. The multi-use garment may be worn by a user in various configurations by folding the body of fabric material and/or orienting the body of fabric material on the user's body and/or interconnecting connecting elements.

In some versions, the multi-use garment further includes a third pair of connecting elements disposed on the front face of the body of fabric material and generally symmetrically disposed on opposite sides of the vertical center line. The first and third pair of connecting elements may be disposed above the horizontal center line. One of the pairs of connecting elements may be disposed at the upper edge of the body of fabric material, wherein when the pair of connecting elements at the upper edge are connected to each other, a neck opening is formed.

In some versions, the multi-use garment has a first pair of sleeve fastening elements disposed adjacent one of the side edges of the body of fabric material. The first pair of sleeve fastening elements are spaced apart from each other with one disposed above the horizontal center line and one disposed below the horizontal center line. A second pair of sleeve fastening elements is disposed adjacent the other of the side edges of the body of fabric material, the second pair of sleeve fastening elements being spaced apart from each other with one disposed above the horizontal center line and one disposed below the horizontal center line. Connecting the first pair of sleeve fastening elements to each other and connecting the second pair of sleeve fastening elements to each other configures the multi-use garment to form two sleeve-like portions for receiving arms of a user when the multi-use garment is wrapped about the user's body.

In some versions, the arm holes are disposed above the horizontal center line. In certain versions, the pocket elements are each disposed near a junction between one of the side edges and the upper edge of the body of fabric material. The pocket elements may be formed of the same fabric material as the body of fabric material. The pocket elements may be stitched to the body of fabric material on three of four sides, the remaining side being unstitched and defining the pocket opening.

In some versions, at least one of the pairs of connecting elements is a pair of elongated ties each having one end attached to the body of fabric material, the ties operable to be tied to each other.

In certain versions, at least one of the pairs of connecting elements is a button and a receiving loop or hole.

Some versions of the multi-use garment further includes a storage pocket element attached to one of the faces of the body of fabric material below the horizontal center line so as to define a storage pocket having a storage pocket opening directed toward the horizontal center line. The storage pocket element may have a design defined on an inner face thereof such that when the storage pocket is turned inside-out and the body of fabric material is stuffed into the inside-out storage pocket, the design is on an outer surface. The storage pocket element may be formed of a water resistant material different from the body of fabric material.

In some versions, the fabric material is a fleece material.

A second embodiment of a multi-use garment includes a generally rectangular body of fabric material having a front face and an opposed rear face, the body of fabric material having an upper edge, a lower edge, and a pair of opposed side edges each extending between the upper and lower edges. A horizontal center line is defined midway between the upper and lower edges and a vertical center line is defined midway between the side edges. A first pair of connecting elements is disposed on the front face of the body of fabric material and generally symmetrically disposed on opposite sides of the vertical center line. A second pair of connecting elements is disposed on the rear face of the body of fabric material and generally symmetrically disposed on opposite sides of the vertical center line. A first pair of sleeve fastening elements is disposed adjacent one of the side edges of the body of fabric material, the first pair of sleeve fastening elements being spaced apart from each other with one disposed above the horizontal center line and one disposed below the horizontal center line. A second pair of sleeve fastening elements is disposed adjacent the other of the side edges of the body of fabric material, the second pair of sleeve fastening elements being spaced apart from each other with one disposed above the horizontal center line and one disposed below the horizontal center line. Connecting the first pair of sleeve fastening elements to each other and connecting the second pair of sleeve fastening elements to each other configures the multi-use garment to form two sleeve-like portions for receiving arms of a user when the multi-use garment is wrapped about the user's body.

In some versions, the garment further includes a third pair of connecting elements disposed on the front face of the body of fabric material and generally symmetrically disposed on opposite sides of the vertical center line. The first and third pair of connecting elements may be disposed above the horizontal center line. One of the pairs of connecting elements is disposed at the upper edge of the body of fabric material, wherein when the pair of connecting elements at the upper edge are connected to each other, a neck opening is formed.

A third embodiment of a multi-use garment includes a generally rectangular body of fabric material having a front face and an opposed back face, the body of fabric material having an upper edge, a lower edge, and a pair of opposed side edges each extending between the upper and lower edges. A horizontal center line is defined midway between the upper and lower edges and a vertical center line is defined midway between the side edges. A first and a second arm hole is through the body of fabric material, the arm holes being above the horizontal center line and generally symmetrically disposed on opposite sides of the vertical center line. A pocket element is attached to the front face of the body of fabric material so as to define a pocket having a pocket opening, the pocket element being disposed above the horizontal center line. The pocket opening is directed toward the vertical center line of the body of fabric material. A first pair of connecting elements is disposed on the front face of the body of fabric material and is generally symmetrically disposed on opposite sides of the vertical center line. An additional pair of connecting elements is disposed on the body of fabric material and generally symmetrically disposed on opposite sides of the vertical center line. The multi-use garment may be worn by a user in various configurations by folding the body of fabric material and/or orienting the body of fabric material on the user's body and/or interconnecting connecting elements.

DETAILED DESCRIPTION OF THE PREFERRED EMBODIMENTS

The present invention provides various embodiments of a multi-use garment having a generally rectangular body of fabric material and a plurality of connecting elements or fastening elements to assist in configuring the garment in a variety of ways. The garment may have a pair of arm holes, a pair of pockets, a storage pocket, and/or other features depending on the specific embodiment.

Figure 1:
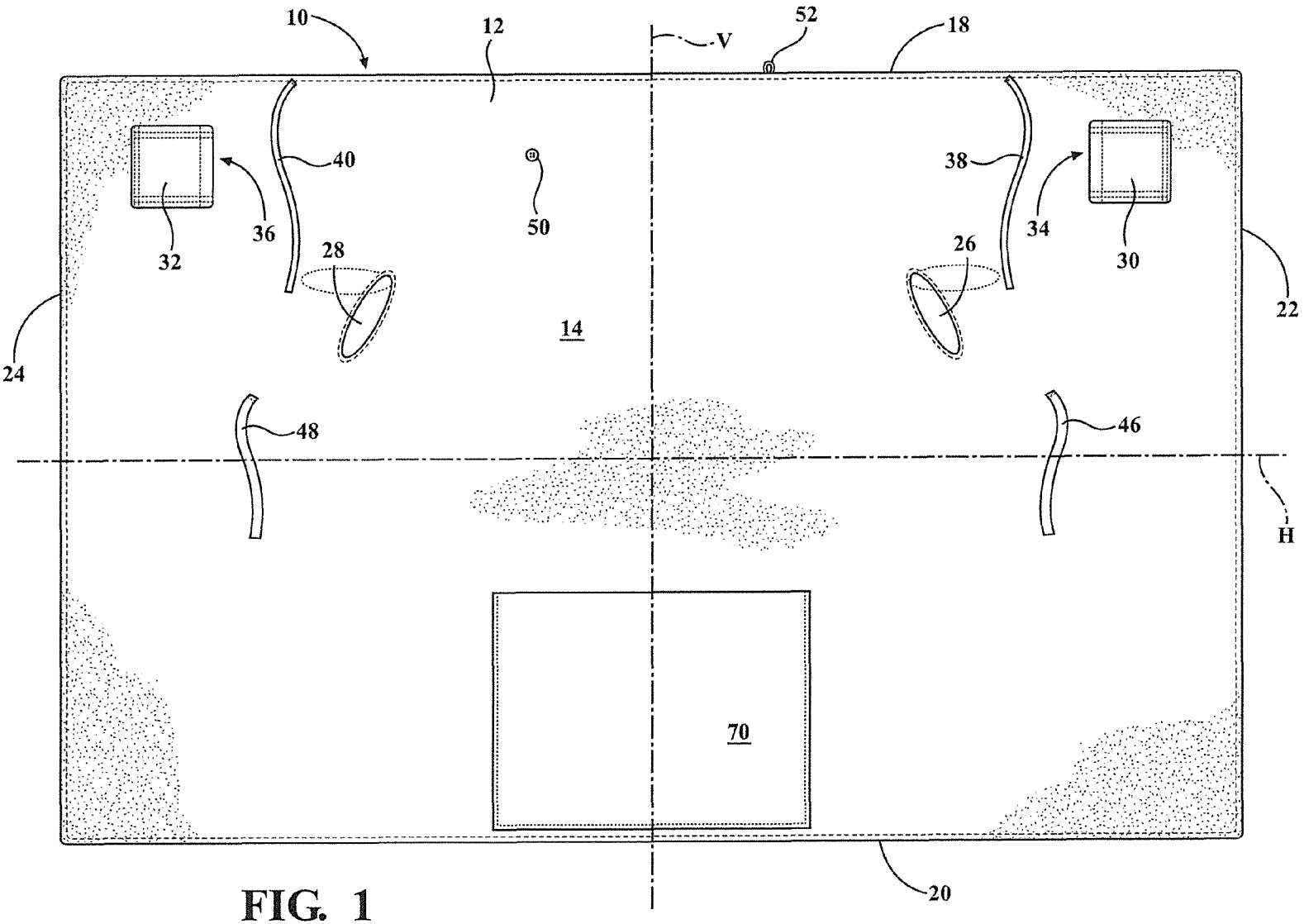
FIG. 1 is a view of a front face of an embodiment of a multi-use garment in accordance with the present invention.
Figure 2:
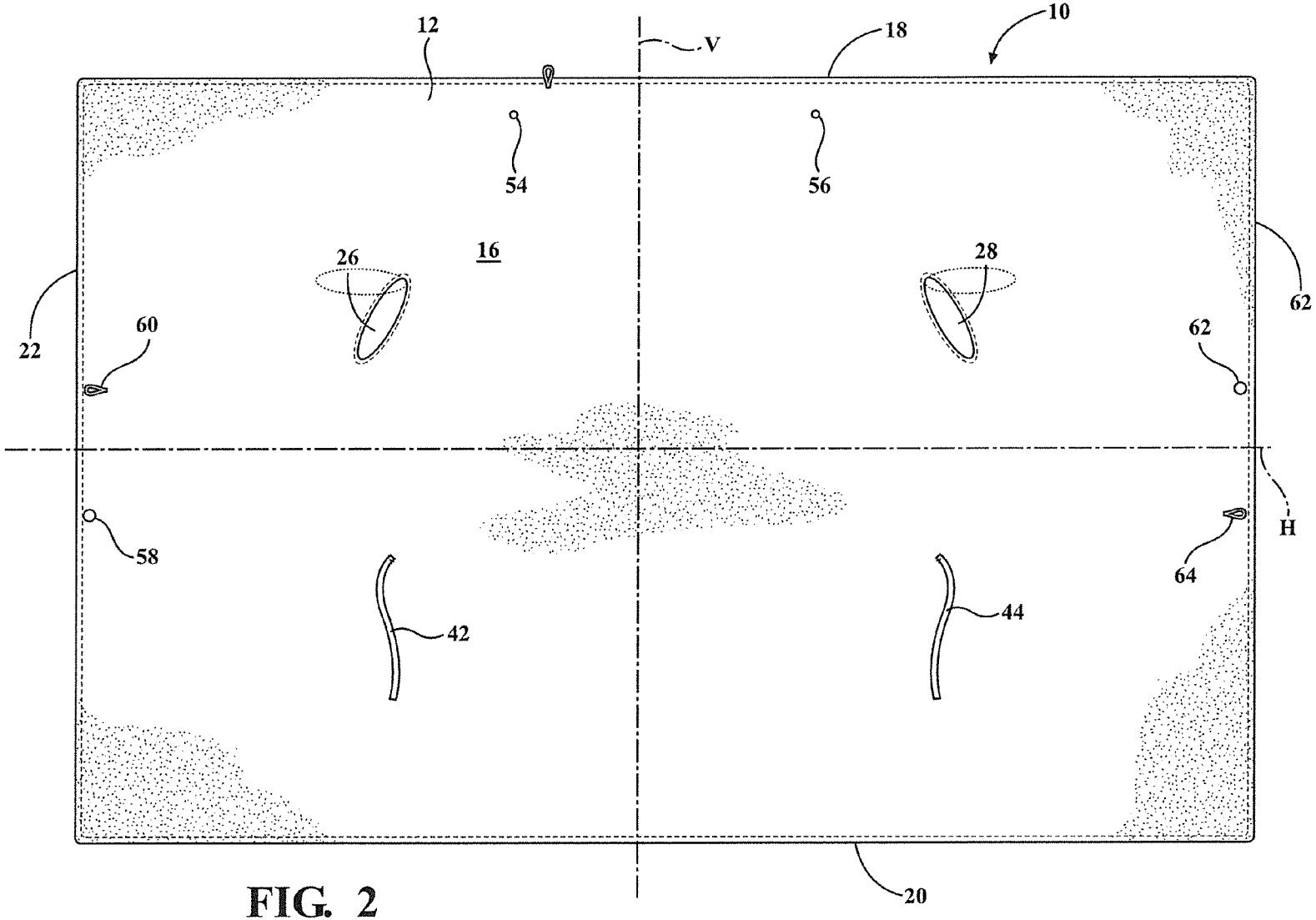
FIG. 2 is a view of a back face of the garment of FIG. 1.

A first embodiment of a multi-use garment in accordance with the present invention is shown at 10 in FIGS. 1 and 2. The garment 10 will be described with reference to the position shown in FIGS. 1 and 2, with FIG. 1 showing a front face of the garment and FIG. 2 showing a back face. However, it will be understood that the garment 10 is formed of a flexible fabric material and may be folded or otherwise manipulated into a non-planar shape. Further, references to upper, lower, above, below, front, back, and similar positional references are used for convenience of description. As will be clear to those of skill in the art, the garment 10 may be reoriented into other positions and the positional references do not limit the orientations in which the garment may be worn or used. Additionally, some of the features illustrated in FIGS. 1 and 2 are optional and may not be included in all embodiments. FIGS. 1 and 2 are generally accurate scale depictions of certain embodiments of the present invention, and therefore may be relied upon to provide relative sizes and positions for such embodiments. However, other embodiments may have different sizes and have features positioned differently than illustrated in FIGS. 1 and 2.

The garment 10 includes a generally rectangular body of fabric material 12 having a front face 14 and a rear face 16. The fabric material may be any of a wide variety of fabrics including, but not limited to, fleece, terrycloth, silk, woven or nonwoven fabrics, t-shirt material, sports fabrics, and others. While the garment 10 is illustrated as having a rectangular shape, various embodiments may be considered to be only generally rectangular, with the shape of the garment being somewhat different than shown. The body of fabric material 12 will be described as having an upper edge 18, a lower edge 20, and a pair of opposed side edges 22 and 24 each extending between the upper and lower edges. The side edge 22 may be considered a right edge and the side edge 24 may be considered a left edge, when viewing the front face as shown in FIG. 1. For ease of reference, the body of fabric material 12 may be considered to have a horizontal center line H defined midway between the upper edge 18 and lower edge 20 and a vertical center line V defined midway between side edge 22 and side edge 24. The center lines H and V are merely for ease of reference and do not represent an actual physical line in or on the body of fabric material 12.

In the embodiment of FIGS. 1 and 2, a first arm hole 26 and a second arm hole 28 are defined through the body of fabric material. As shown, the arm holes 26 and 28 are above the horizontal centerline H and are generally symmetrically disposed on opposite sides of the vertical center line V. As shown, the arm holes 26 and 28 are angled outwardly with their upper portions closer together than their bottom portions. Alternatively, the arm holes may be positioned differently, such as shown in phantom lines, extending more horizontally.

In the illustrated embodiment, a first pocket element 30 and a second pocket element 32 are each attached to the front face 14 of the body of fabric material 12. Each pocket element 30 and 32 is a piece of material, such as the same material forming the body 12, which is attached at the front face 14 so as to define a first and a second pocket. Each pocket may be said to have a pocket opening, 34 and 36 respectively. In the illustrated version, each pocket element is generally rectangular and three of its four sides are stitched to the body of fabric material 12 and a fourth side is left unstitched, defining the pocket opening 34 or 36. The pocket openings may be said to be directed inwardly towards the vertical center line V of the body of fabric material 12. As also shown, the pocket elements 30 and 32 are generally symmetrically disposed on opposite sides of the vertical center line and also are disposed above the horizontal center line H. The pocket elements and their respective pockets may be shaped or angled differently than shown. However, it is preferred that the openings 34 and 36 are directed inwardly and that the pocket elements are generally symmetrical and above the horizontal center line H. In the illustrated embodiment, the pocket elements 30 and 32 are close to the junction between the respective side edges 22 and 24 and the upper edge 18.

A first pair of connecting elements 38 and 40 are disposed on the front face 14 of the body of fabric material 12. In the illustrated embodiment, the connecting elements are generally symmetrically disposed on opposite sides of the vertical center line V and at the upper edge 18. The connecting elements may take a variety of forms such as elongated strings or ribbons of material that can be tied. Alternatively, the connecting elements 38 and 40, or any other connecting or fastening element used in the invention, may take other forms, including cooperative snap elements, a button and a loop or hole, or cooperating pieces of hook-and-loop fastener material. The connecting elements 38 and 40 are illustrated as ties having one end connected at the upper edge 18 of the body of fabric material 12. When the position of a connecting or fastening element is discussed, its position is considered to be where it attaches to the body of fabric material 12. Referring to FIG. 2, a second pair of connecting elements 42 and 44 are disposed on the rear face 16 of the body of fabric material 12 and are generally symmetrically disposed on opposite sides of the vertical center line V. In this version, the connecting elements 42 and 44 are elongated ties with one end fastened to the body of fabric material 12. In this version, the second pair of connecting elements 42 and 44 are disposed below the horizontal center line H.

Referring again to FIG. 1, a third pair of connecting elements 46 and 48 are disposed on the front face 14 of the body of fabric material 12 and are generally symmetrically disposed on opposite sides of the vertical center line V. In this version, the third pair of connecting elements are elongated ties with one end connected to the body of material fabric 12 above the horizontal center line H and below the first pair of connecting elements 38 and 40.

Some embodiments of the present invention may include neck forming elements such as button 50 and loop 52 and/or snaps 54 and 56. By connecting the button 50 to the loop 52 or connecting the snap 54 to the snap 56, a neck opening may be provided. Alternatively, the first pair of connecting elements 38 and 40 may be tied to one another to form a neck opening.

Figure 3:
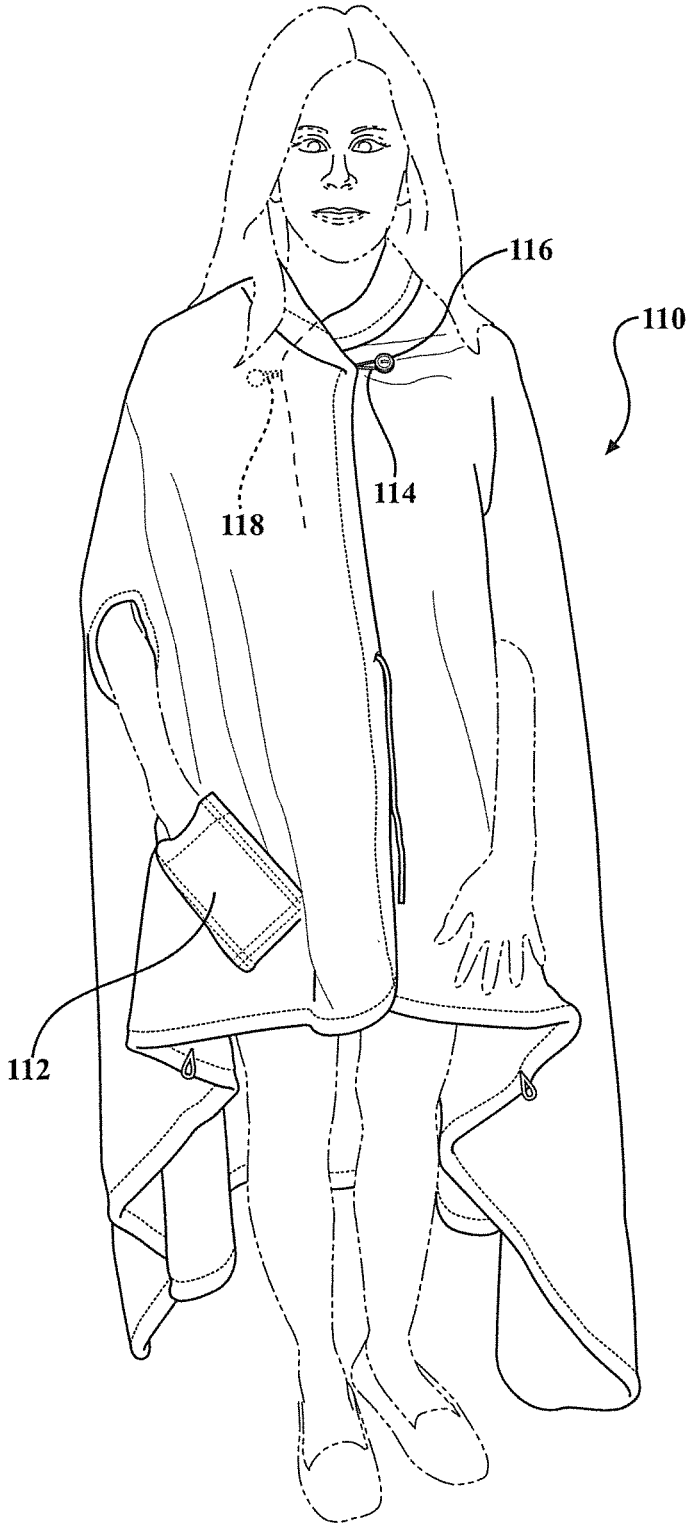
FIG. 3 is a perspective view of an embodiment of a garment in accordance with the present invention worn in a first configuration.

Referring now to FIG. 3, an alternative embodiment of a garment as shown at 110 is shown worn by a user in a first configuration. The embodiment of the garment 110 is very similar to the embodiment 10 but with a single pocket element disposed at a different angle. While only a single pocket element 112 is shown in FIG. 3, an additional pocket element may be provided on the other side of the garment 110. In order to achieve the first configuration of FIG. 3, the garment 10 or 110 is positioned with the rear face 16 against the user's back and the upper edge 18 near their neck. The neck closures are interconnected. In FIGS. 1 and 2, this means connecting button 50 to loop 52 or snap 54 to snap 56. In the embodiment of FIG. 3, a loop 114 engages a button 116. This forms a neck opening around the user's neck and the garment 10 or 110 is then wrapped around the user's body with the pocket element in front of the torso. The user places their arms through the arm holes 26 and 28 so as to pass from the rear face 16, which is against the body, to the front face 14, which is the outer surface in the first configuration of FIG. 3. Additional connecting elements, such as shown at 118, may be provided for further shaping the neck opening.

Figure 4:
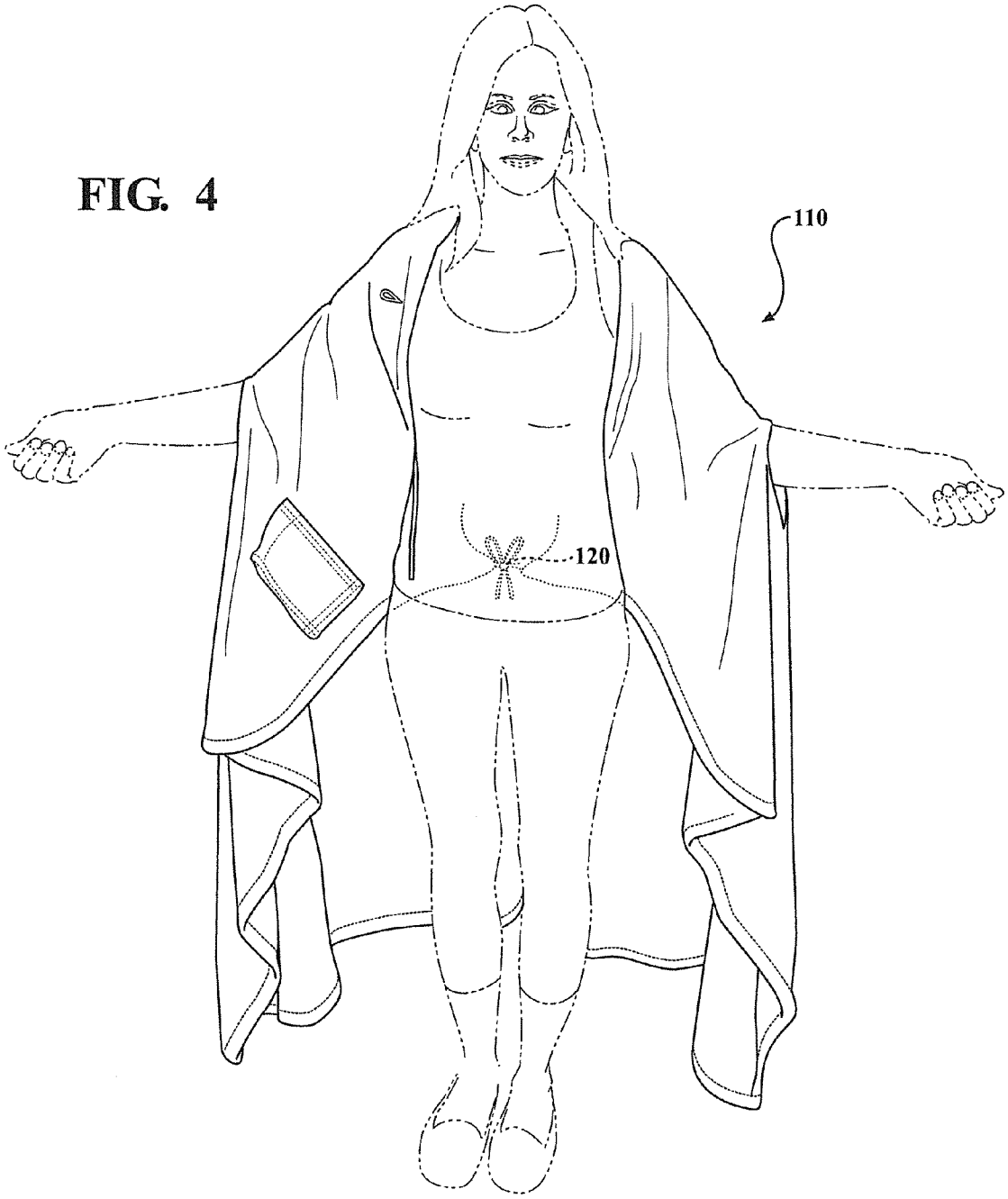
FIG. 4 is a perspective view of the garment of FIG. 3 in a second configuration.

FIG. 4 shows a second configuration of the garment 110. This configuration is similar to the first configuration of FIG. 3 in that the rear face 16 is against the user's back, but the first pair of connecting elements (38 and 40 in FIG. 1) are tied together behind the user's body as shown at 120.

Figure 5:
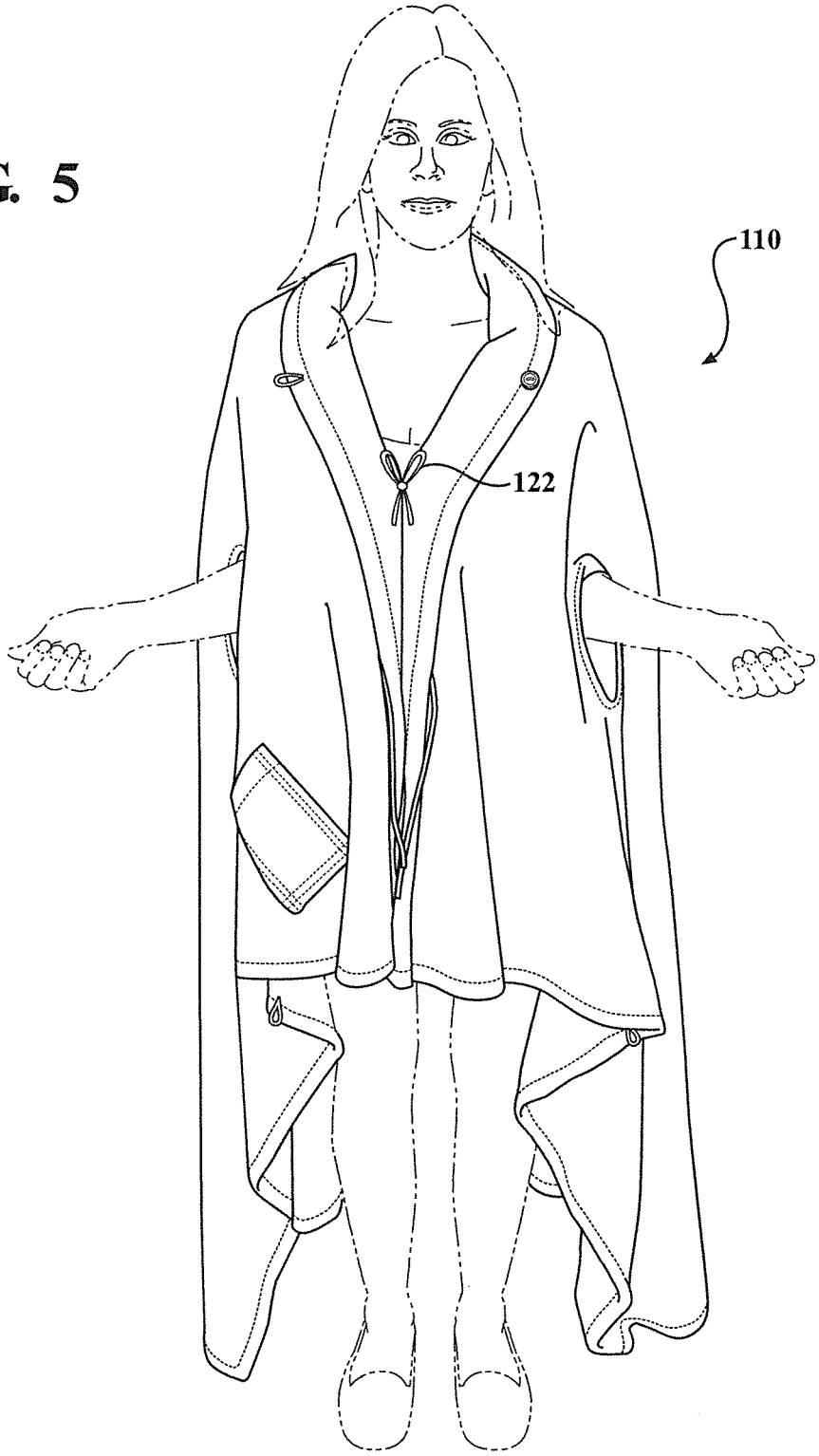
FIG. 5 is a perspective view of the garment of FIGS. 3 and 4 in a third configuration.

FIG. 5 shows a third configuration of the garment 110 in which additional connecting elements 122 join the sides of the garment together at a lower position, again forming a neck opening. Again, the rear face 16 of the garment is against the user's body and the arms pass through the arm holes from the rear face 16 to front face 14.

Figure 6:
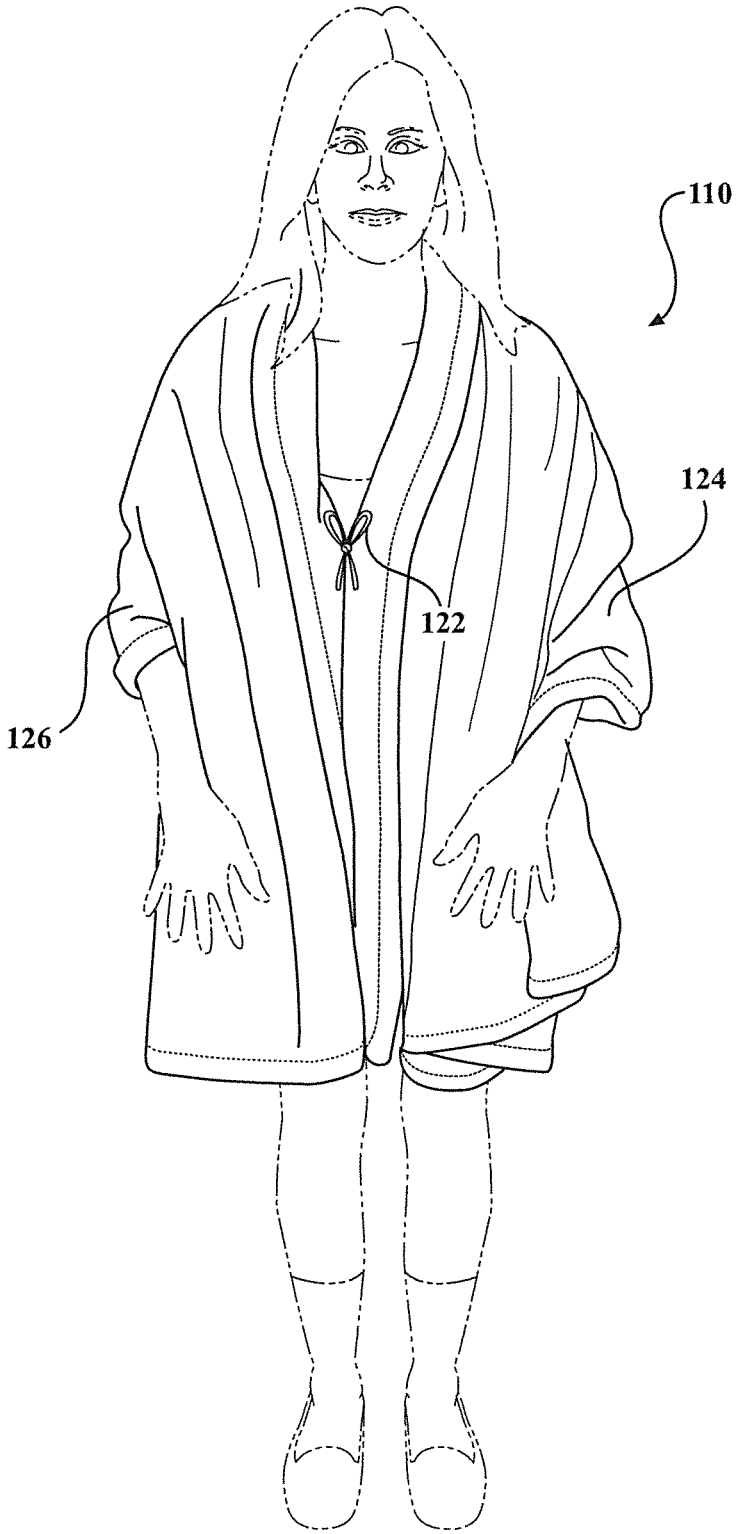
FIG. 6 is a perspective view of the garment of FIGS. 3-5 in a fourth configuration.
Figure 7:
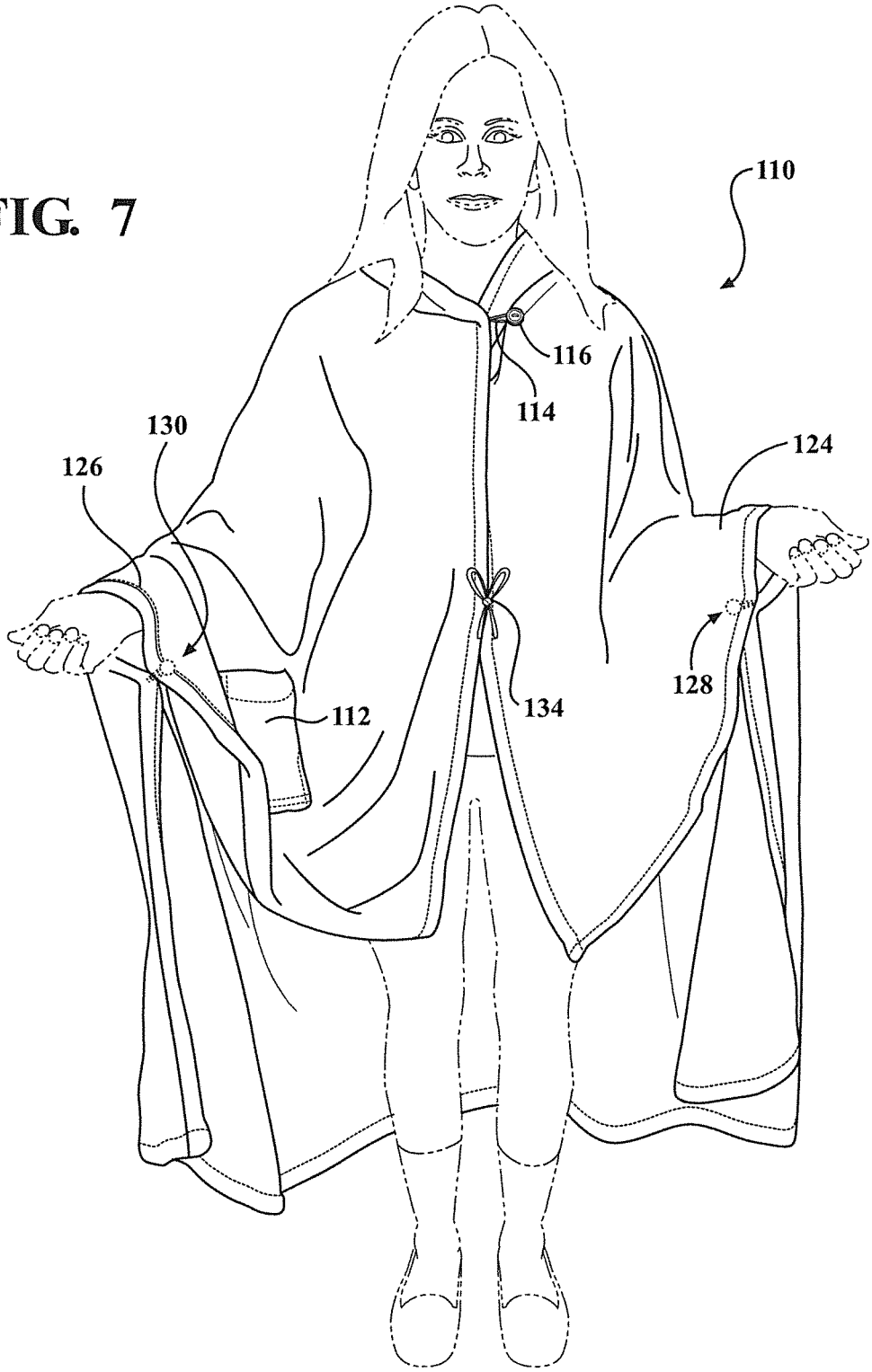
FIG. 7 is a perspective view of the garment of FIGS. 3-6 in a fifth configuration.

Referring again to FIGS. 1 and 2, some embodiments of the present invention are provided with sleeve fastening elements that allow a user to configure the garment 10 to form two sleeve-like portions for receiving the user's arms. In the illustrated embodiment, a first pair of sleeve fastening elements 58 and 60 are provided on the rear face 16 of the body of fabric material 12 adjacent the side edge 22. In this version, the fastening elements take the form of a button 58 and a loop 60, though other types of connecting elements may be used. As shown, the button 58 is disposed below the horizontal center line and the loop 60 is disposed above the horizontal center line H. A second pair of sleeve fastening elements 62 and 64 are provided adjacent the other side edge 24 and are positioned with the button 62 above the horizontal center line and the loop 64 positioned below the horizontal center line H. The sleeve fastening elements 58-64 may alternatively be disposed on the front face 14 or on the actual edges 22 and 24. Referring to FIG. 6, the garment 110 is shown in a fourth configuration wherein the sleeve fastening elements (hidden in this view) are interconnected so as to form sleeve-like portions 124 and 126. Again, the back face 16 of the garment is positioned against the user's back with the upper edge 18 adjacent the user's neck. The user then positions their arms through the sleeve-like portions and through the openings formed by the sleeve fastening elements. Connecting elements such as 122 may be again interconnected to hold the front of the garment closed. FIG. 7 shows a fifth configuration, which is similar to the fourth configuration, with the user illustrated as having their arms held outwardly. Again, the sleeve-like portions 124 and 126 receive the user's arms. As shown, the pocket element 112 is disposed on the inner side of the user's arms so that when the arms are folded back to the position of FIG. 6, the pocket is hidden. In FIG. 7, the sleeve fastening elements 128 and 130 are partially shown. In the fifth configuration of FIG. 7, the loop 114 is engaging the button 116 to form a neck opening and the first pair of connecting elements 134 (38 and 40 in FIG. 1) are tied together to hold the front of the garment 110 closed.

Figure 8:
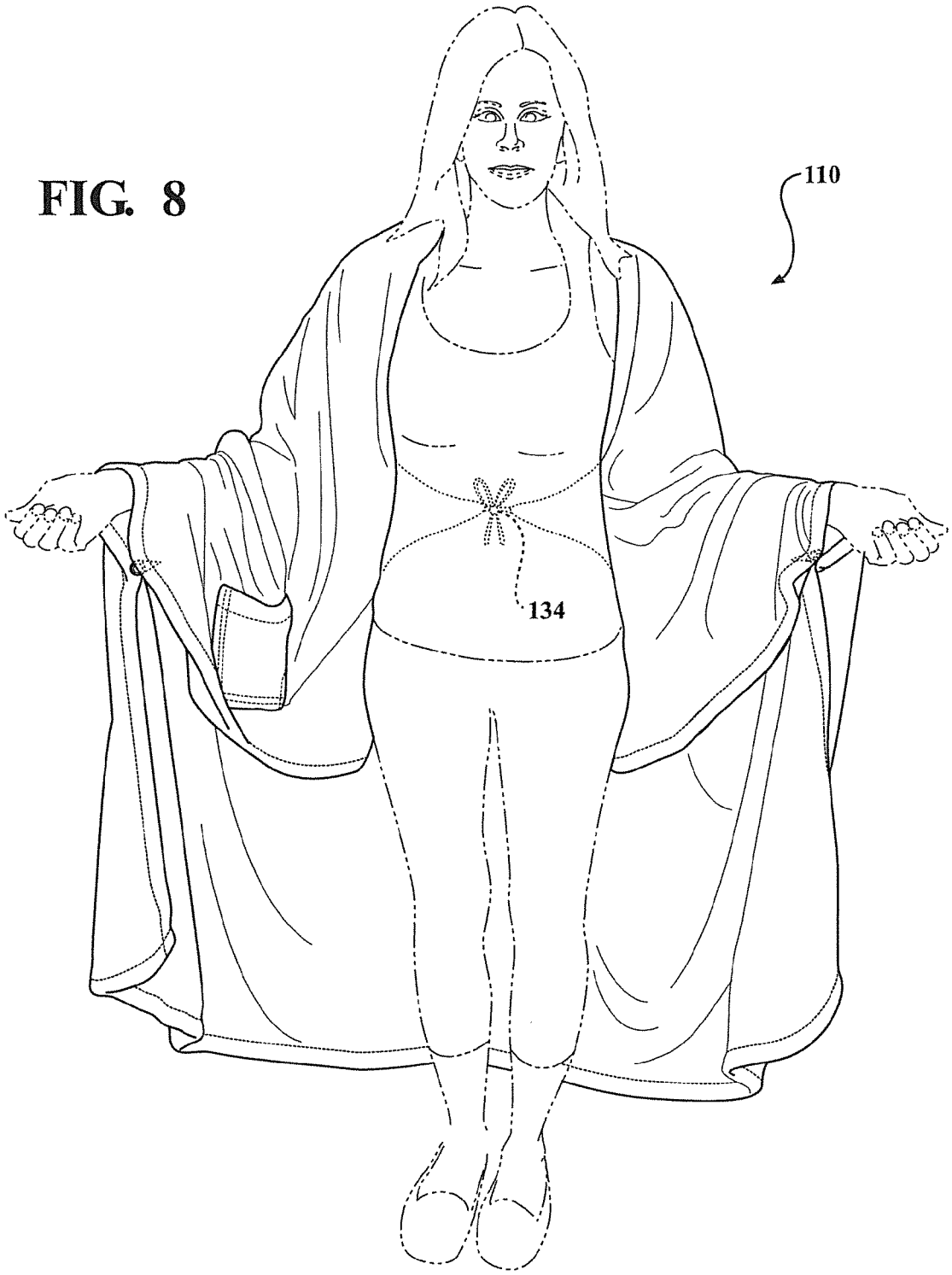
FIG. 8 is a perspective view of the garment of FIGS. 3-7 in a sixth configuration.

FIG. 8 shows a sixth configuration of the garment 110, which is similar to the configuration of FIG. 7. In this configuration, the first pair of connecting elements 134 are tied together behind the user's back to provide a more open configuration.

Figure 9:
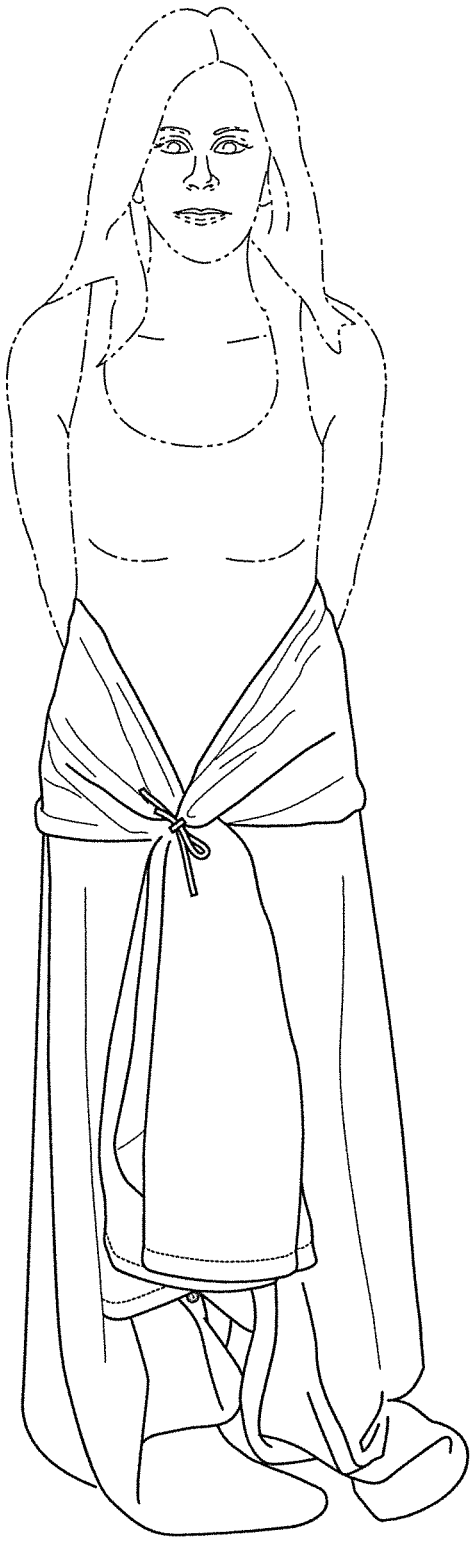
FIG. 9 is a perspective view of the garment of FIGS. 3-8 in a seventh configuration.
Figure 10:
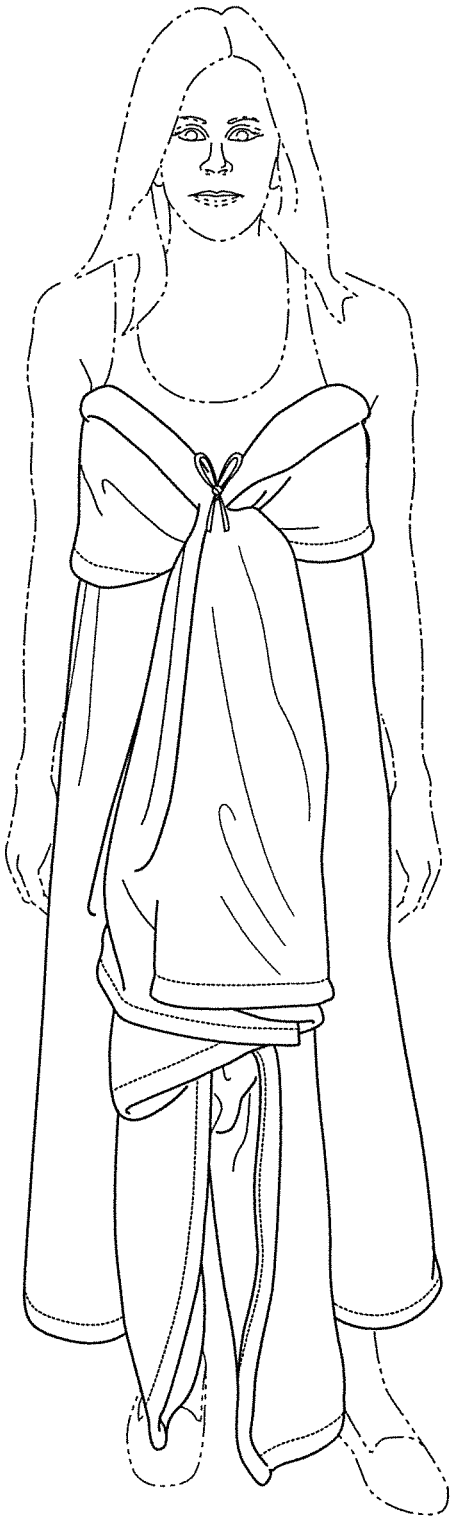
FIG. 10 is a perspective view of the garment of FIGS. 3-9 in an eighth configuration.
Figure 11A:
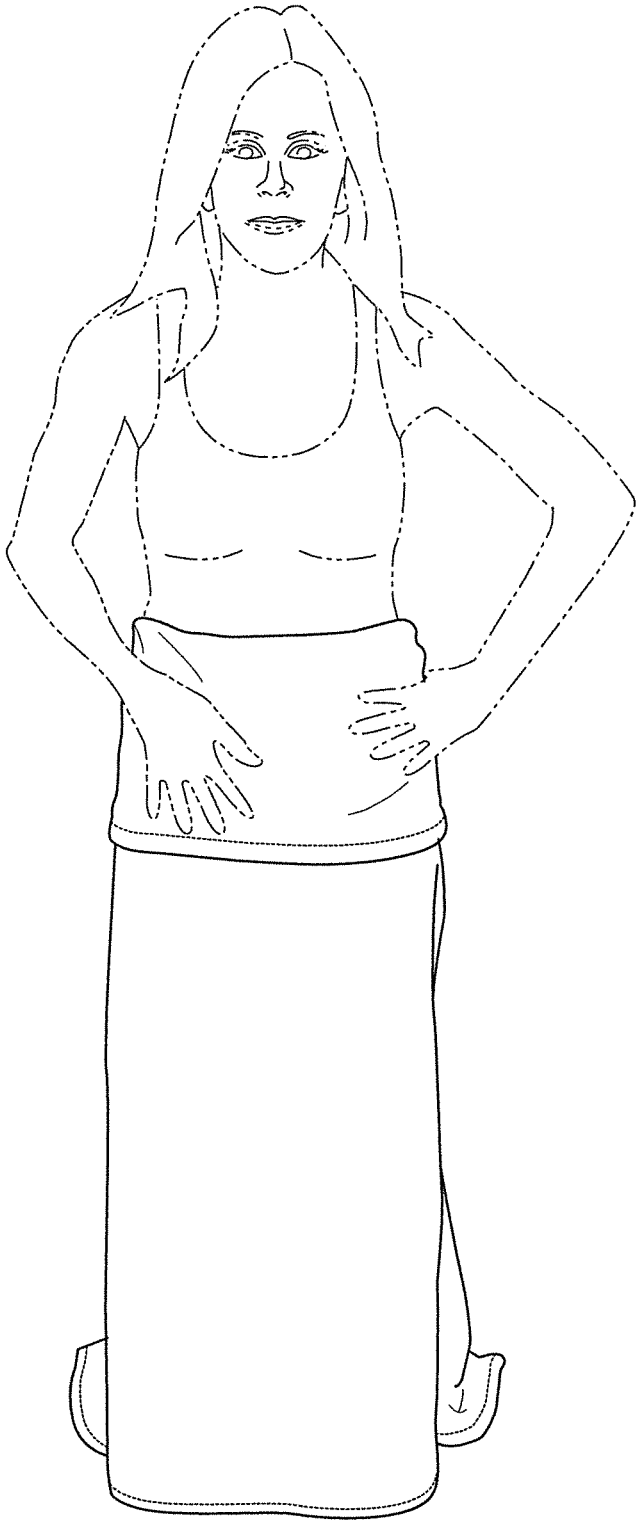
FIG. 11A is a front perspective view of the garment of FIGS. 3-10 in a ninth configuration.
Figure 11B:
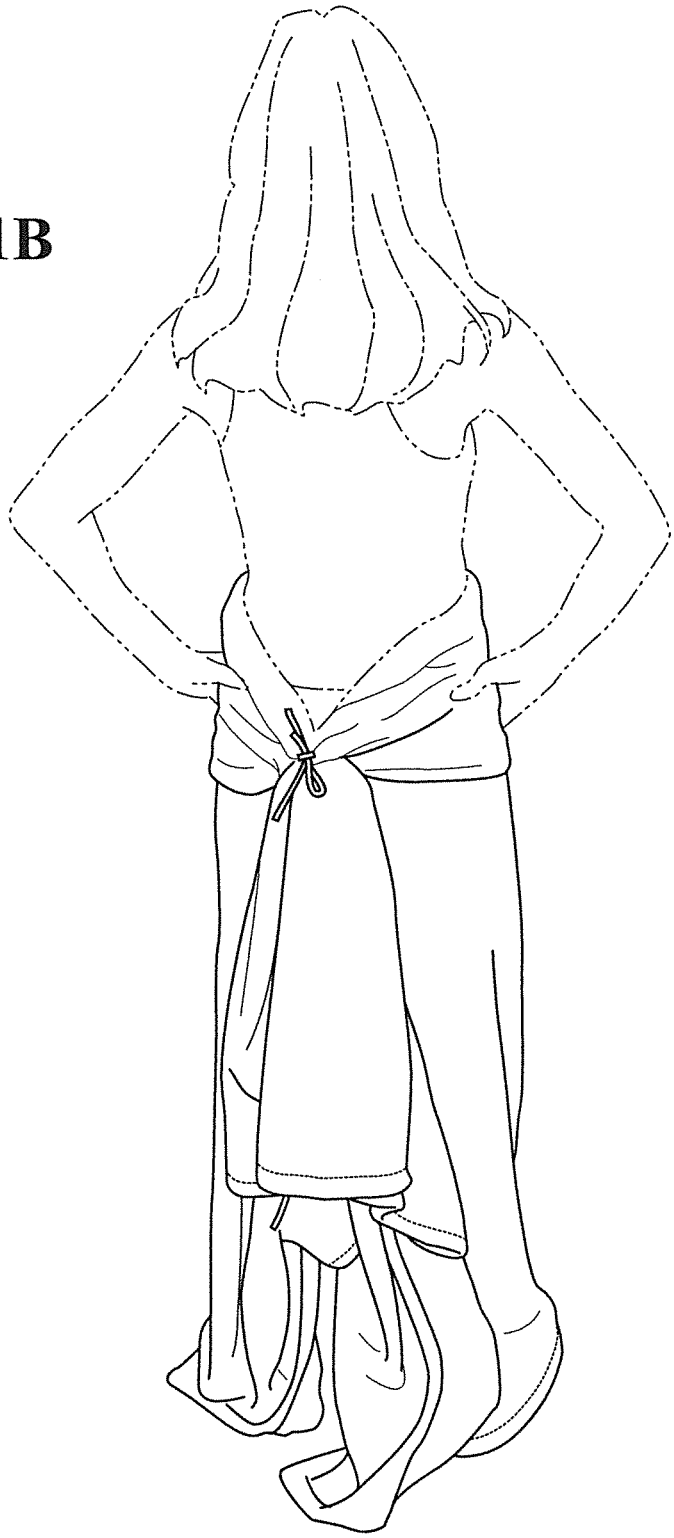
FIG. 11B is a rear perspective view of the configuration of FIG. 11A.
Figure 12A:
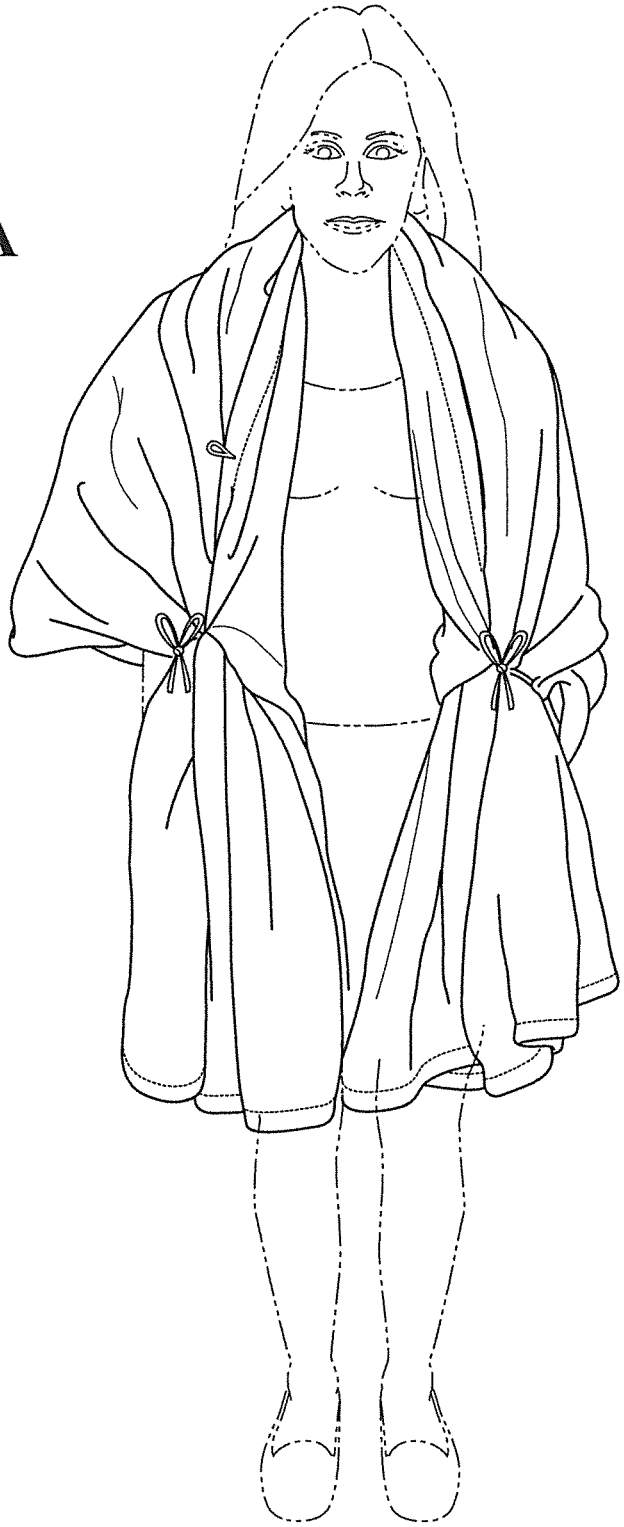
FIG. 12A is a front perspective view of the garment of FIGS. 3-11 in a tenth configuration.
Figure 12B:
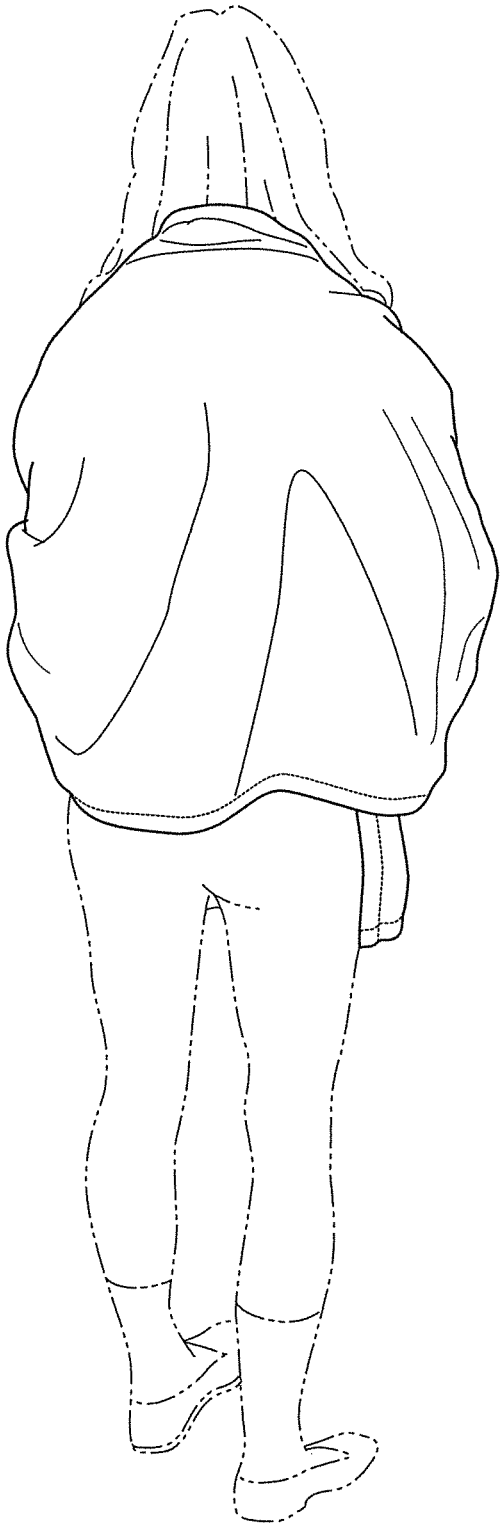
FIG. 12B is a rear perspective view of the configuration of FIG. 12A.

Referring now to FIGS. 9-11B, the garment 110 may also be worn in a skirt-like or dress-like configuration. For these configurations, the first connecting elements 38 and 40 are passed through the arm holes on the opposite side of the garment and then tied together. In FIGS. 9 and 10, the ties are in the front. In FIGS. 11A and 11B, the ties are in the back Referring to FIGS. 12A and 12B, the garment may also be worn as a shawl without the arms passing through arm holes or sleeve-like portions. In this configuration, the garment is generally bunched up, top to bottom, and then the first connecting elements are wrapped around each end of the bunched up garment and tied back to themselves. FIG. 12A shows the shawl from the front and FIG. 12B shows the shawl from the rear.

Figure 13:
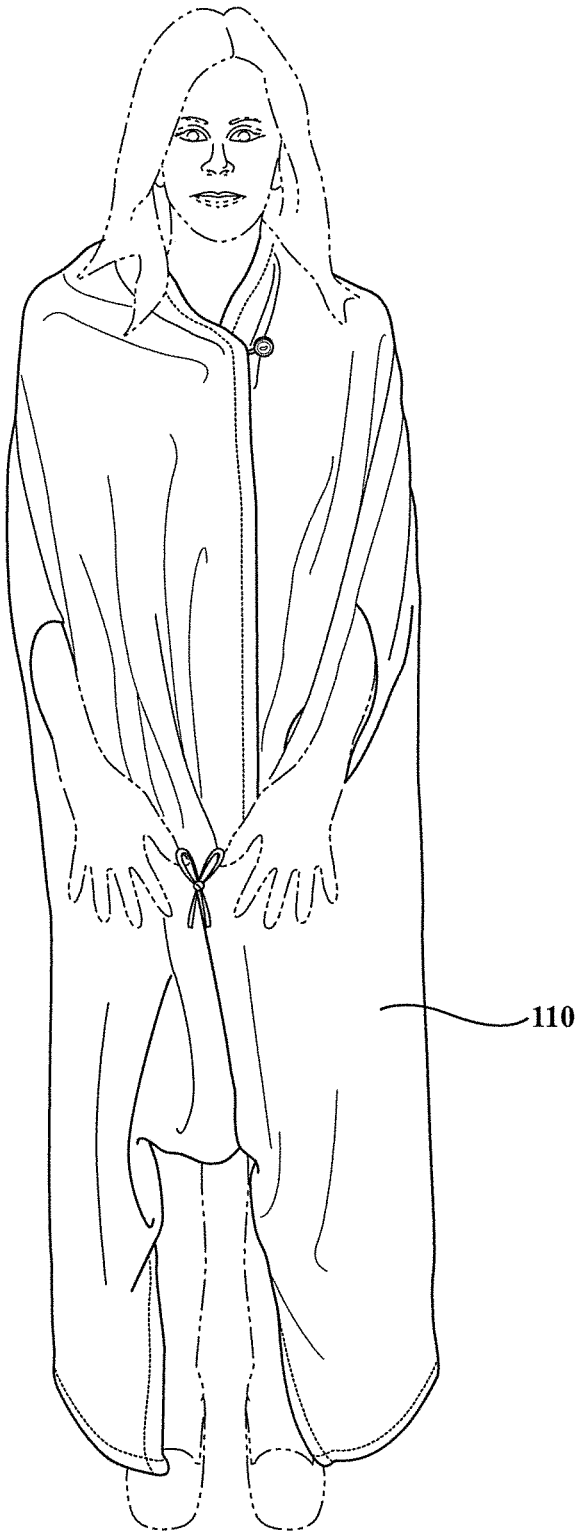
FIG. 13 is a perspective view of the garment of FIGS. 3-12 in an eleventh configuration.

FIG. 13 shows a further configuration wherein the lower portion of the garment 110 is tied together so as to cover the user's legs.

Figure 14:
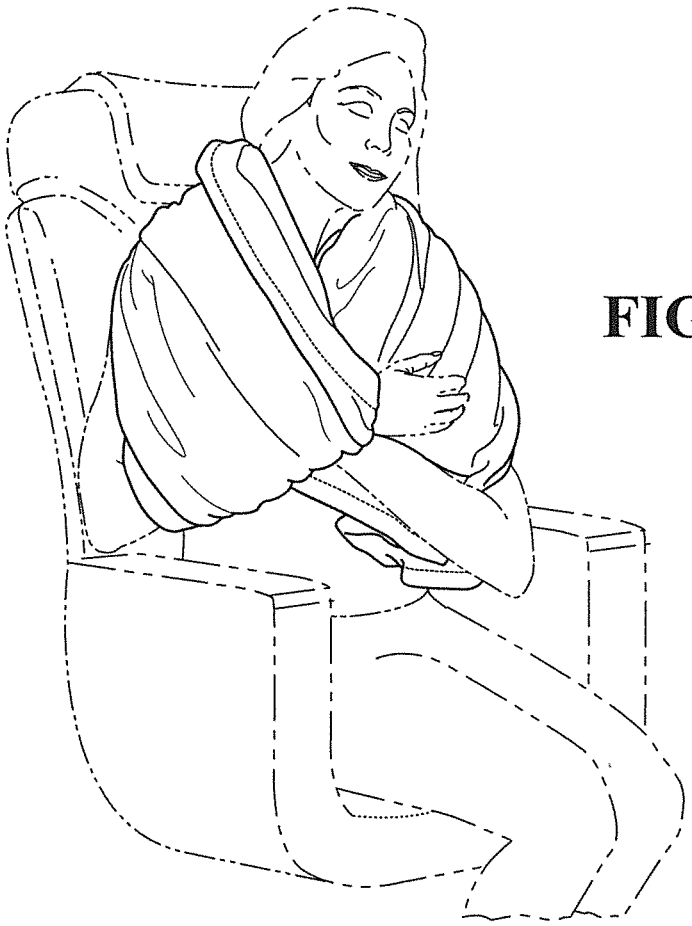
FIG. 14 is a perspective view of the garment of FIGS. 3-13 in a twelfth configuration.

FIG. 14 shows another configuration where the user is sitting and the garment is folded side to side and then wrapped around their neck like a neck pillow, and may be used for resting the user's head while sitting.

Figure 15:
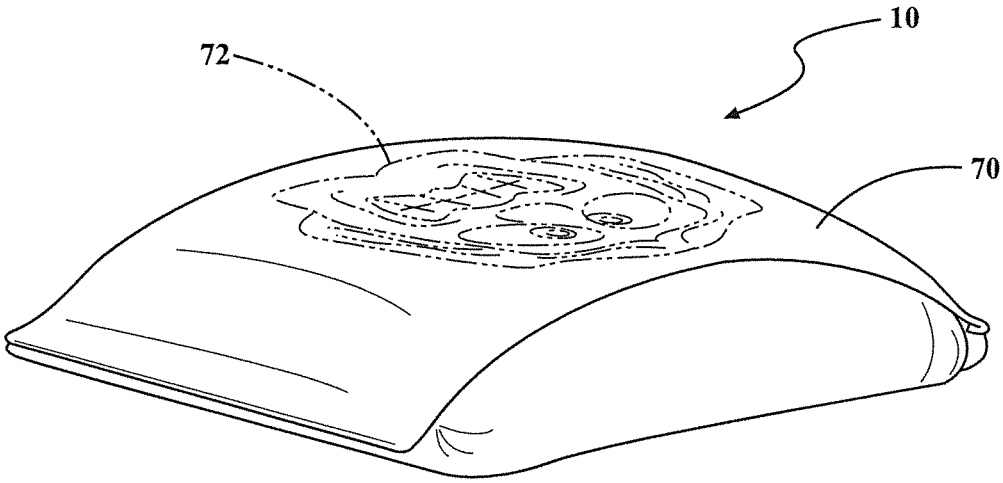
FIG. 15 is a perspective view of the embodiment of FIGS. 1 and 2 in a storage configuration.

Referring again to FIG. 1, some embodiments of a garment in accordance with the present invention include a storage pocket into which the remainder of the garment may be stuffed for storage. In FIG. 1, a storage pocket element 70 is disposed on the front face 14, generally centered with respect to the vertical center line V and adjacent the lower edge 20. The pocket element 70 may be joined to the body of fabric material 12 at its lower edge and side edges with the upper edge of the pocket element 70 left open. In one preferred approach, the pocket formed by the pocket element is turned inside-out and the remainder of the garment 10 is stuffed into the inside-out pocket. FIG. 15 shows the resulting configuration, in which the garment 10 is in a storage configuration. The inner surface of the pocket element 70 may have a design provided thereon such that when the pocket is turned inside-out and stuffed with the remainder of the garment, the garment 10 forms a pillow with a design 72 on its outer surface. The pocket element 70 is also positioned such that it will be against the user's back when the garment is worn in most configurations, thereby hiding the pocket from view. This makes it useful as a storage pouch, if desired. The pocket element may be formed of a material that is water resistant so that a user can sit on the garment with the pocket element beneath them and avoid water from the ground penetrating the garment.

The garment in accordance with the present invention may come in a variety of sizes, shapes, and configurations. Referring to FIGS. 1 and 2, the side to side (22 to 24) width may be about 60 inches for a child-size, about 70 inches for a medium or woman's size, and about 90 inches for a large or man's size. Further embodiments may have a width in the range of 50 to 100 inches. The top to bottom (18 to 20) height may be about 38 inches for a child-size, about 52 inches for a medium or woman's size, and about 46-50 inches for a large or man's size. Further embodiments may have a height in the range of 30 to 60 inches. Larger sizes will typically have the arm holes farther apart. The closest distance between the arm holes width may be about 24 to 30 inches for a child-size, about 30 to 36 inches for a medium or woman's size, and about 40-48 inches for a large or man's size. The length of each arm opening may also be scaled with the size of the garment, ranging from 6 to 10 inches. In some versions, the distance between the upper edge 18 and the upper end of the arm holes may be about 12 inches for a child-size, about 15-16 inches for a medium or woman's size, and about 18-24 inches for a large or man's size. The location of the connecting elements may vary with size, with the ratios being about as shown in FIGS. 1 and 2. In some versions, the third connecting elements may be connected lower than shown, such as approximately 22 inches from the bottom of a medium size, positioning them below the horizontal center line. The sleeve forming fastening elements, such as 62 and 64 may be approximately equidistant from the upper and lower edges and be approximately 8 to 20 inches apart. The neck forming fasteners may be spaced apart at a variety of distances, such as 14 to 30 inches apart.

Unlike most garments, the illustrated embodiments of the present invention do not have any portions that are folded over and sewn to other portions, other than small folded areas at the edges or around arm holes. In most garments, portions of fabric are folded or otherwise positioned and then sewn to other portions, such as to form sleeves or legs or body portions. Embodiments of the present invention, on the other hand, comprise an essentially sheet-like body of material wherein no portions are sewn or fixed to other portions. The connecting and fastening elements allow temporary connections, but the portions are not sewn to each other or fixed to each other as with other garments. The connecting and fastening elements may be disconnected from one another and the garment may then be laid flat and have the appearance of FIG. 1 or 2.

As will be clear to those of skill in the art, the embodiments of the present invention illustrated and discussed herein may be altered in various ways without departing from the scope or teaching of the present invention. As non-limiting examples, further embodiments may have only a single pocket, no pockets, may be provided without arm holes, or may include fewer or more connecting or fastening elements. It is the following claims, including all equivalents, which define the scope of the present invention.

The invention claimed is:

1. A multi-use garment, comprising:

a generally rectangular body of fabric material having a front face and an opposed rear face, the body of fabric material having an upper edge, a lower edge, and a pair of opposed side edges each extending between the upper and lower edges, a horizontal center line being defined midway between the upper and lower edges and a vertical center line being defined midway between the side edges;

a first and a second arm hole defined through the body of fabric material, the arm holes being generally symmetrically disposed on opposite sides of the vertical center line;

a first and a second pocket element each attached to the front face of the body of fabric material so as to define a respective first and second pocket each having a pocket opening, the first and second pocket elements being generally symmetrically disposed on opposite sides of the vertical center line and being disposed above the horizontal center line, the pocket openings each being directed toward the vertical center line of the body of fabric material;

a first pair of connecting elements disposed on the front face of the body of fabric material, each of the first pair of connecting elements being an elongated tie having one end directly attached on the body of fabric material at a location spaced from each of the pocket openings and an opposite end extending therefrom, the first pair of connecting elements being generally symmetrically disposed on opposite sides of the vertical center line, wherein one of the first pair of connecting elements is operable to be joined to the other of the first pair of connecting elements so that the fabric material on the opposite sides of the vertical center line is brought together to form a wraparound configuration of the multi-use garment around or behind a user's body;

a second pair of connecting elements disposed on the rear face of the body of fabric material and generally symmetrically disposed on opposite sides of the vertical center line, each of the second pair of connecting elements being an elongated tie having one end directly attached on the body of fabric material and an opposite end extending therefrom, wherein one of the second pair of connecting elements is operable to be joined to the other of the second pair of connecting elements so that the fabric material on the opposite sides of the vertical center line is brought together to form a wrap-around configuration of the multi-use garment around or behind the user's body;

wherein the connecting elements are each joinable to any of the other connecting elements to form a plurality of configurations of the multi-use garment; and wherein the multi-use garment is adapted to be worn by a user in various configurations by folding the body of fabric material and/or orienting the body of fabric material on the user's body and/or interconnecting connecting elements.

2. A multi-use garment in accordance with claim 1, farther comprising a third pair of connecting elements disposed on the front face of the body of fabric material and generally symmetrically disposed on opposite sides of the vertical center line, wherein one of the third pair of connecting elements is operable to join to the other of the third pair of connecting elements so that the fabric material forms a wrap-around configuration of the multi-use garment around the user's body, and wherein any connecting elements are each operable to be joined to any other connecting elements so that the fabric material is adapted to form a plurality of configurations of the multi-use garment on the user's body.

3. A multi-use garment in accordance with claim 2, wherein the first and third pair of connecting elements are disposed above the horizontal center line.

4. A multi-use garment in accordance with claim 1, further comprising:

a pair of neck-opening-forming connecting elements disposed at the upper edge of the body of fabric material;

the neck-opening-forming connecting elements selected from the group consisting of buttons, loops and snaps; and wherein when the pair of neck-opening-forming connecting elements at the upper edge are connected to each other, a neck opening is formed.

5. A multi-use garment in accordance with claim 1, further comprising:

a first pair of sleeve fastening elements disposed adjacent one of the side edges of the body of fabric material, the first pair of sleeve fastening elements being spaced apart from each other with one disposed above the horizontal center line and one disposed below the horizontal center line;

a second pair of sleeve fastening elements disposed adjacent the other of the side edges of the body of fabric material, the second pair of sleeve fastening elements being spaced apart from each other with one disposed above the horizontal center line and one disposed below the horizontal center line;

wherein connecting the first pair of sleeve fastening elements to each other and connecting the second pair of sleeve fastening elements to each other configures the multi-use garment to form two sleeve-like portions for receiving arms of the user when the multi-use garment is wrapped about the user's body.

6. A multi-use garment in accordance with claim 1, wherein the arm holes are disposed above the horizontal center line.

7. A multi-use garment in accordance with claim 1, wherein the pocket elements are each disposed near a junction between one of the side edges and the upper edge of the body of fabric material.

8. A multi-use garment in accordance with claim 1, wherein the pocket elements are formed of the same fabric material as the body of fabric material.

9. A multi-use garment in accordance with claim 1, wherein the pocket elements are stitched to the body of fabric material on three of four sides, the remaining side being unstitched and defining the pocket opening.

10. A multi-use garment in accordance with claim 2, wherein the third pair of connecting elements is a pair of elongated ties each having one end attached to the body of fabric material, the ties operable to be tied to each other.

11. A multi-use garment in accordance with claim 1, further comprising a button attached to the body of fabric material and a receiving loop attached to the body of fabric material or hole defined in the body of fabric material.

12. A multi-use garment in accordance with claim 1, further comprising a storage pocket element attached to one of the faces of the body of fabric material below the horizontal center line so as to define a storage pocket having a storage pocket opening directed toward the horizontal center line.

13. A multi-use garment in accordance with claim 12, wherein the storage pocket element has a design defined on an inner face thereof such that when the storage pocket is turned inside-out and the body of fabric material is stuffed into the inside-out storage pocket, the design is on an outer surface.

14. A multi-use garment in accordance with claim 12, wherein the storage pocket element is formed of a water resistant material different from the body of fabric material.

15. A multi-use garment in accordance with claim 1, wherein the fabric material is a fleece material.

16. A multi-use garment, comprising:

a generally rectangular body of fabric material having a front face and an opposed rear face, the body of fabric material having an upper edge, a lower edge, and a pair of opposed side edges each extending between the upper and lower edges, a horizontal center line being defined midway between the upper and lower edges and a vertical center line being defined midway between the side edges;

a first and a second pocket element each attached to the front face of the body of fabric material so as to define a respective first and second pocket each having a pocket opening, the first and second pocket elements being generally symmetrically disposed on opposite sides of the vertical center line and being disposed above the horizontal center line, the pocket openings each being directed toward the vertical center line of the body of fabric material;

a first pair of connecting elements disposed on the front face of the body of fabric material, each of the first pair of connecting elements being an elongated tie having one end directly attached on the body of fabric material at a location spaced from each of the first and second pocket openings and an opposite end extending therefrom, the first pair of connecting elements being generally symmetrically disposed on opposite sides of the vertical center line, wherein one of the first pair of connecting elements is operable to be joined to the other of the first pair of connecting elements so that the fabric material on the opposite sides of the vertical center line is brought together to form a wraparound configuration of the multi-use garment around or behind a user's body;

a second pair of connecting elements disposed on the rear face of the body of fabric material and generally symmetrically disposed on opposite sides of the vertical center line, each of the second pair of connecting elements being an elongated tie having one end directly attached on the body of fabric material and an opposite end extending therefrom, wherein one of the second pair of connecting elements is operable to be joined to the other of the second pair of connecting elements so that the fabric material on the opposite sides of the vertical center line is brought together to form a wrap-around configuration of the multi-use garment around or behind the user's body;

a third pair of connecting elements disposed on the front face of the body of fabric material and generally symmetrically disposed on opposite sides of the vertical center line, each of the third pair of connecting elements being an elongated tie having one end attached to the body of fabric material and an opposite end extending therefrom, wherein one of the third pair of connecting elements is operable to join to the other of the third pair of connecting elements so that the fabric material forms a wrap-around configuration of the multi-use garment around the user's body;

wherein any connecting elements are each joinable to any other connecting elements to form a plurality of configurations of the multi-use garment;

a first pair of sleeve fastening elements disposed adjacent one of the side edges of the body of fabric material, the first pair of sleeve fastening elements being spaced apart from each other with one disposed above the horizontal center line and one disposed below the horizontal center line; and a second pair of sleeve fastening elements disposed adjacent the other of the side edges of the body of fabric material, the second pair of sleeve fastening elements being spaced apart from each other with one disposed above the horizontal center line and one disposed below the horizontal center line;

wherein connecting the first pair of sleeve fastening elements to each other and connecting the second pair of sleeve fastening elements to each other configures the multi-use garment to form two sleeve-like portions for receiving arms of a user when the multi-use garment is wrapped about the user's body.

17. A multi-use garment in accordance with claim 16, wherein the first and third pair of connecting elements are disposed above the horizontal center line.

18. A multi-use garment in accordance with claim 17, further comprising:

a pair of neck-opening-forming connecting elements disposed at the upper edge of the body of fabric material;

the neck-opening-forming connecting elements selected from the group consisting of buttons, loops and snaps;

wherein when the pair of neck-opening-forming connecting elements at the upper edge are connected to each other, a neck opening is formed.

19. A multi-use garment, comprising:

a generally rectangular body of fabric material having a front face and an opposed rear face, the body of fabric material having an upper edge, a lower edge, and a pair of opposed side edges each extending between the upper and lower edges, a horizontal center line being defined midway between the upper and lower edges and a vertical center line being defined midway between the side edges;

a first and a second arm hole defined through the body of fabric material, the arm holes being generally symmetrically disposed on opposite sides of the vertical center line;

a pocket element attached to the front face of the body of fabric material so as to define a pocket having a pocket opening, the pocket element being disposed above the horizontal center line, the pocket opening being directed toward the vertical center line of the body of fabric material;

a first pair of connecting elements disposed directly on the front face of the body of fabric material, each of the first pair of connecting elements being an elongated tie having one end attached to the body of fabric material at a location spaced from each of the pocket openings and an opposite end extending therefrom, the first pair of connecting elements being generally symmetrically disposed on opposite sides of the vertical center line, wherein one of the first pair of connecting elements is operable to be joined to the other of the first pair of connecting elements so that the fabric material on the opposite sides of the vertical center line is brought together to form a wrap-around configuration of the multi-use garment around or behind a user's body;

a second pair of connecting elements disposed on the rear face of the body of fabric material and generally symmetrically disposed on opposite sides of the vertical center line, each of the second pair of connecting elements being an elongated tie having one end attached directly on the body of fabric material and an opposite end extending therefrom, wherein one of the second pair of connecting elements is operable to be joined to the other of the second pair of connecting elements so that the fabric material on the opposite sides of the vertical center line is brought together to form a wrap-around configuration of the multi-use garment around or behind the user's body;

a third pair of connecting elements disposed on the front face of the body of fabric material and generally symmetrically disposed on opposite sides of the vertical center line, each of the third pair of connecting elements being an elongated tie having one end attached to the body of fabric material and an opposite end extending therefrom, wherein one of the third pair of connecting elements is operable to join to the other of the third pair of connecting elements so that the fabric material forms a wrap-around configuration of the multi-use garment around the user's body;

wherein the connecting elements are each joinable to any of the other connecting elements to form a plurality of configurations of the multi-use garment; and wherein the multi-use garment may be worn by a user in various configurations by folding the body of fabric material and/or orienting the body of fabric material on the user's body and/or interconnecting connecting elements.

* * * * *